US005131465A

United States Patent [19]

Langston

[11] Patent Number: 5,131,465

[45] Date of Patent: Jul. 21, 1992

[54] PERFORATING APPARATUS FOR CIRCULATING CEMENT

[75] Inventor: Thomas L. Langston, New Iberia, La.

[73] Assignee: Arrow Electric Line, Inc., Lafayette, La.

[21] Appl. No.: 617,211

[22] Filed: Nov. 23, 1990

[51] Int. Cl.[5] ..... E21B 43/117

[52] U.S. Cl. ..... 166/55.1; 175/4.6; 102/319; 102/321

[58] Field of Search ..... 166/55, 55.1; 175/4.6; 102/312, 319; 89/1.15

[56] References Cited

U.S. PATENT DOCUMENTS 3,104,709 9/1963 Kenneday et al. ..... 166/55.1 X
3,371,741 3/1968 Haxby ..... 102/319 X
3,405,769 10/1968 Shore et al. ..... 175/4.6 X
3,415,321 12/1968 Verghiattis ..... 175/4.6 X
4,844,167 7/1989 Clark ..... 175/4.53

*Primary Examiner*—William P. Neuder
*Attorney, Agent, or Firm*—Dodge, Bush, Moseley & Riddle

[57] ABSTRACT

In accordance with an illustrative embodiment of the present invention, a perforating gun apparatus for forming holes in a well casing through which cement can be circulated includes a mandrel, four arm-mounted, shaped charge carriers on the body, and bow springs on the body in the plane of each carrier for biasing the carriers outward into sliding contact with the well casing. The charges form evenly distributed series of vertically arranged holes the casing, without damage to an outer casing string, so that cement can be circulated through the holes and into the annulus without channeling.

20 Claims, 2 Drawing Sheets

PERFORATING APPARATUS FOR CIRCULATING CEMENT

FIELD OF THE INVENTION

This invention relates generally to an apparatus for perforating well casing to enable circulation of cement without channeling, and particularly to a new and improved perforating gun having a plurality of angularly spaced shaped charge carriers that are biased outward into engagement with the casing wall, and arranged to shoot holes in an inner casing string without damaging an outer casing string.

BACKGROUND OF THE INVENTION

When cement slurry is displacing down into a well casing and out into the annular space between such casing and a surrounding well casing, it is imperative that the cement completely fill such annulus. Unless this occurs, there can be channels that form in the cement before it hardens, and through which formation fluids, such as salt water, can migrate so that a complete shut off is not achieved. Where channels are present, it is necessary to recement the casing with the objective of closing off such channels. A complete shut off is particularly important where a well is being plugged and abandoned.

Applicant has found that better cementing results can be obtained if the inner casing string is perforated in a manner such that a plurality of angularly spaced, vertical series of holes are formed that allow circulation of cement through such holes and into the annulus outside. This process provides a uniform distribution of a large number of small, individual cement flow paths, and prevents the formation of channels in the annulus. In accordance with a further aspect of the present invention, the shaped charges are arranged to form holes in the inner casing string without damaging an outer string of casing that surrounds such inner casing string. The shaped charges are arranged within carriers that are pressed against the casing wall by bias means, and in such a manner that any debris remains within the carriers, and no trash is left in the well.

A general object of the present invention is to provide a new and improved casing perforating apparatus for forming circulation paths through the wall of a casing.

Another object of the present invention is to provide a new and improved perforating gun that forms a plurality of evenly distributed flow paths in the wall of a casing so that cement can be placed behind the casing without formation of channels.

SUMMARY OF THE INVENTION

These another objects are attained in accordance with the concepts of the present invention through the provision of a perforating gun apparatus that includes a tubular body or mandrel having a plurality of outwardly extending bow springs thereon which apply outwardly directed bias forces. A plurality of elongated shaped charge carriers, each one arranged in the same radial plane as one of the bow springs, are mounted on the body by upper and lower arm structures. Each bow spring bears against a rear wall of a respective carrier, so as to force it outward into sliding engagement with the well casing wall. A plurality of shaped charges are mounted in each carrier, and are arranged to be fired by an explosive cord that leads to a detonator, such as blasting cap. Each detonator is connected by a conductor wire to a conductive member inside the mandrel, and a ground wire connects each detonator to the mandrel. A cable head that is attached to the upper end of the mandrel couples a conductor wire in an armored electric cable to the mandrel conductor, so that the shaped charges can be fired in response to an electrical signal applied to the cable at the surface. The shaped charges are designed such that they will form individual holes through the casing wall to the annulus outside, but will not damage the wall of a casing string that surrounds the casing that is being perforated.

BRIEF DESCRIPTION OF THE DRAWINGS

The present invention has other objects, features and advantages that will become more clearly apparent in connection with the following detailed description of a preferred embodiment, taken in conjunction with the appended drawings, in which.

DETAILED DESCRIPTION OF THE PREFERRED EMBODIMENT

Figure 1:
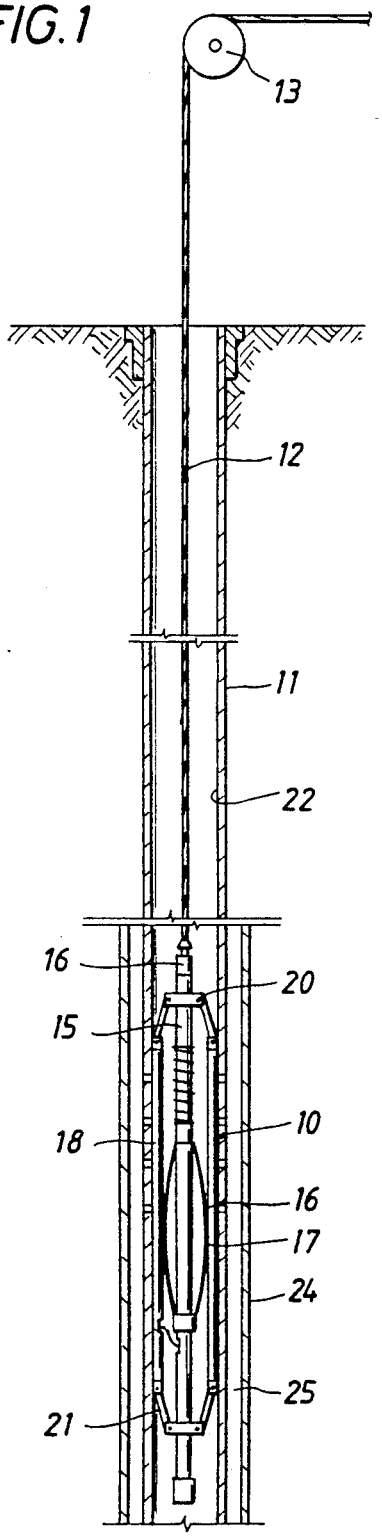
FIG. 1 is a schematic view of the present invention being lowered into a well casing.

Referring initially to FIG. 1, a perforation gun 10 is shown being lowered into a well casing 11 on an electric wireline or cable 12. The cable 12 extends over a sheave 13 and to a wireline service truck (not shown) having a wench to reel the cable in and out. The cable 12 generally is called a "monocable" because it typically has only a single electrical conductor inside a core that has armor wires wound on its outside. The armor wires provide a ground return path for the flow of electric current that is applied at the truck to the electrical conductor in the cable.

The perforating gun 10 includes a tubular mandrel or body 15 that is attached to a head 16 on the lower end in the cable 12. The body 15 carries four bow, or belly, springs 17 that are mounted at 90° intervals. In the same radial plane as each bow spring 17 is a carrier tube 16 that is mounted on the body 15 by upper and lower pivot arms 20, 21. Each bow spring 17 engages a rear surface of a respective carrier tube 18, and bias it outward into sliding engagement with the inner wall 22 of the casing 11. Each carrier tube 18 has a plurality of vertically arranged, radially oriented shaped charges therein. An outer casing 24 surrounds the inner casing 11 to form an annulus 25 therebetween.

Figure 2A:
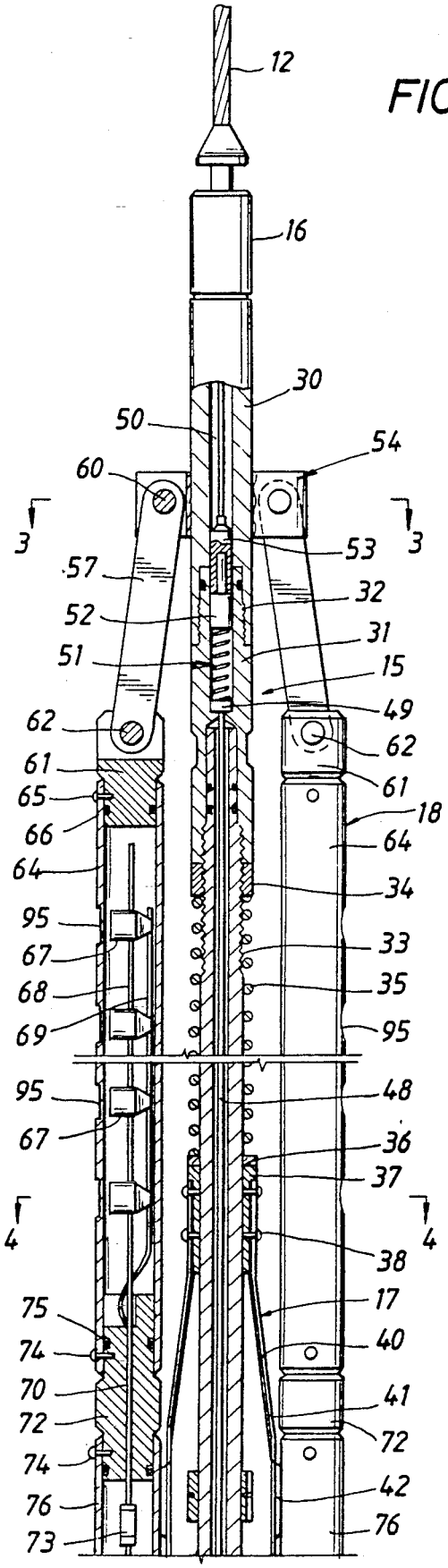
FIGS. 2A and 2B are longitudinal sectional views of the present invention with some parts in side elevation, FIG. 2B being a lower continuation of FIG. 2A.
Figure 2B:
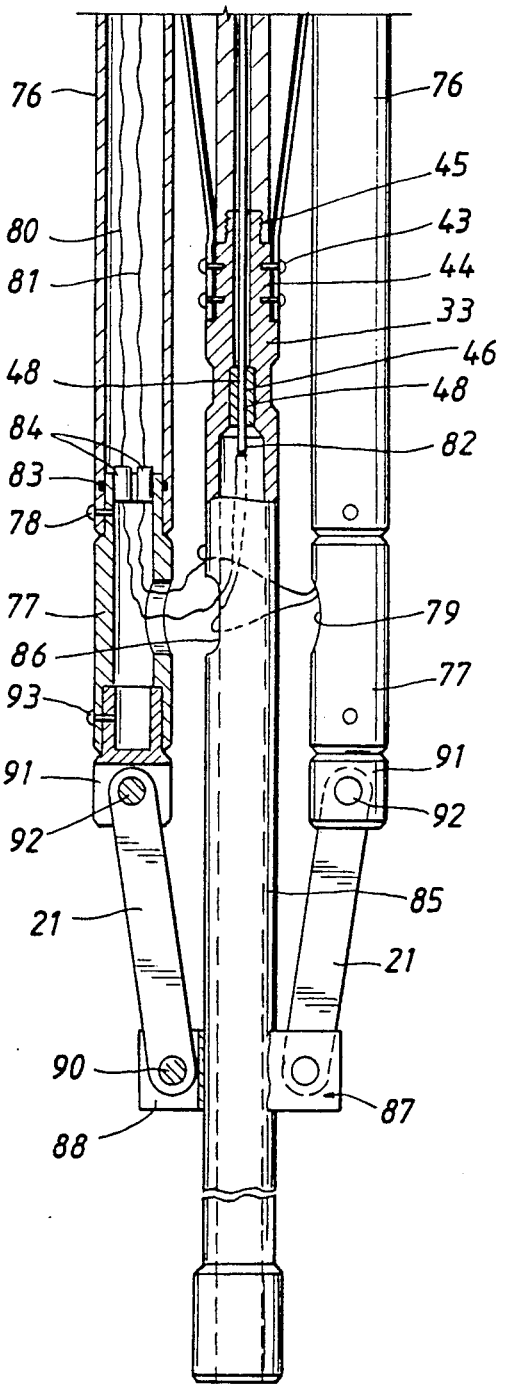
Figure 4:
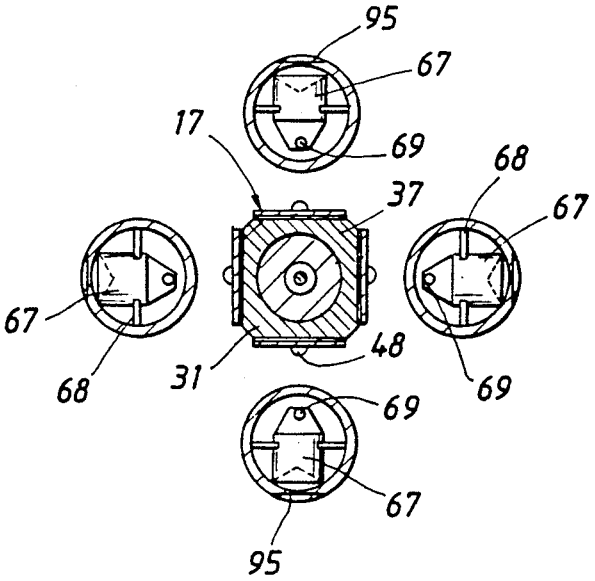

With reference to FIG. 2A, where the body of the tool and those parts on the left side are shown in section, and the parts on the right side are shown in elevation, the tubular body 15 includes an upper sub 30 that is screwed onto the upper end of a mandrel 31 at 32. The mandrel 31 has a section of threads 33 on its upper portion which are engaged by an adjusting nut 36. A coil spring 35 reacts between the nut 34 and a washer 34 that bears against a collar 37 that can slide on the exterior of the mandrel 31. Cap screws 38 serve to fasten the upper ends of the bow springs 17 to the collar 37. Each bow spring 17 comprises a slick inner member 40 and a wear hardened outer member 41, both of which bow outward in a convex manner as shown. A wear pad 42 can be fixed to the center of each spring assembly. Cap screws 43 fasten the lower ends of the bow springs 17 to a spring anchor sub 44 that is threaded to the lower end in the mandrel 31 at 45. An insulator sleeve 46 (FIG. 2B) is mounted in the bore of the sub 44, and receives the lower end of an elongated, conductive brass rod 48 that extends upward through the bore of the mandrel 31 to where it is threaded to a nut 49 in the upper sub 31 in order to hold the rod in tension. A contact assembly 51 is electrically coupled to the rod 48, and includes a male plug 52 with which a companion female plug 53 is mated. An insulated conductor 50 extends upward from the plug 53 to the cable head 16 where it is electrically connected to the center conductor of the cable 12.

Figure 3:
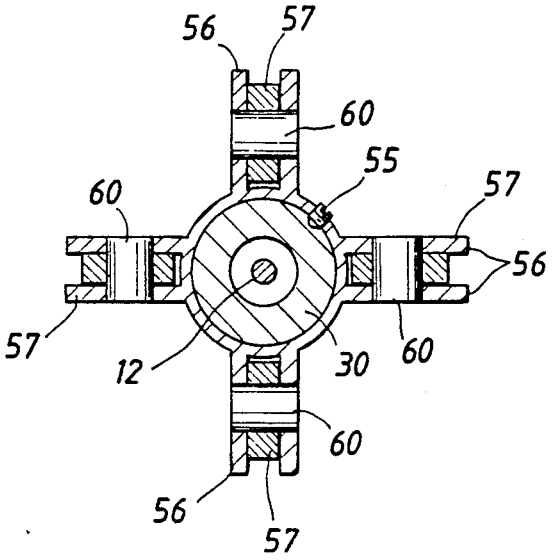
FIGS. 3 and 4 are cross-sections taken on lines 3—3 and 4—4. of FIG. 2A.

The hollow adapter sleeve 30 which threads onto the top of the sub 31 and to the bottom of the cable head 16, has mounted thereon a spider 54. The spider 54, which is fixed to the sub 30 by a set screw 55, has four pairs of parallel plates 56 mounted at 90° to one another as shown in FIG. 3. Pivot arms 57 that have their upper ends connected to respective pairs of the plates 56 by pins 60 extend downward and outward to the top of plugs 61 where they are connected in slots therein by pins 62. Each plug 61 is secured to the top of a tubular carrier 64 by set screws 65. An O-ring 66 between these members prevents fluid leakage. Each carrier tube 64 houses a plurality of vertically aligned shaped charges 67 that are mounted on a strip 68. An explosive cord 69 is attached to the rear of each charge 67, and extends downward through a passage 70 in a connector sub 72 to a detonator, or blasting cap 73 that functions to detonate the cord 69, and thus the charges 67, when a certain level of electric current is applied to it. The sub 72 is coupled by screws 74 and 0-rings 75 between the lower end of the carrier tube 64 and the upper end of a cap holder tube 76 which houses the detonators 73 and the conductor wires leading to and from it.

The lower end of the holder tube 76 to attached to an adapter 77 (FIG. 2B) by screws 78. Hereagain an 0-ring prevents fluid leakage at the connection. A window 79 is formed in the inner wall of the adapter 77 to enable the wires 80 and 81, which lead from the detonator 73 to mating plugs that are sealingly mounted in the upper end portion of the adapter 77, to pass inward toward the lower end of the mandrel 33. The conductor 81 is grounded with respect to the mandrel 33 by a screw or the like, and the conductor 80, which is the firing line, is connected by a suitable connection 82 to the lower end of the conductive rod 48.

Another elongated sub 85, whose principle function is to provide weight which causes the assembly to slide downward in the casing 11, has a window 86 that allows the wire 81 to extend to the connection 82. Another spider 87 is slidably mounted on the sub 85, and has four angularly spaced pairs of parallel plates 88 that receive the lower ends of the linkage arms 21 which are secured by pivot pins 90. The upper end of each respective arm 21 is pivotally connected to a slot in the lower end of a plug member 91 by a pin 92, the plug member being coupled to the lower end of the adapter 77 by screws 93.

The circuit for firing the shaped charges 67 comprises the conductor wire in the armored cable 12, the conductor 50, the plug 53 and the contact assembly 51, the metal rod 48, the lead 80 that goes to the blasting cap 73, other wires (not shown) that connect the other three blasting caps in series with the cap 73, the ground wires 81 that connect each cap to the mandrel 33, the mandrel 15, the body of the cable head 16, and the armor wires of the cable 12 which are grounded at the top of the well. A normally-open firing switch in the truck is closed after the perforating gun 10 has been lowered to the proper depth in the casing 11, which causes detonation of the blasting caps and explosion of the cords 69 and the shaped charges 67. The walls of the carrier tubes 64 directly in front of each shaped charge 67 are flattened on the outside to provide thin sections 95 of the wall.

OPERATION

In operation, the perforating gun 10 is assembled as shown in the drawings and is lowered into the inner casing string 11 on the cable 12 until the shaped charges 67 are located at the proper depth interval. During lowering, the outer surfaces of the carrier tubes 64 slide against the casing wall, however, the weight of the assembly is sufficient to cause its downward movement. Each carrier tube 64 is biased outward by a bow spring 17 so as to always engage the casing wall. The upper spider 54 is fixed to the sub 30 by the set screw, however the lower spider 87 can move upward and downward to accommodate lateral movement of the carrier tubes 64.

At perforating depth the gun assembly is halted, and then fired by closing a switch at the service truck in a line from a power supply leading to the center conductor of the cable 12. Firing the detonators 73 causes the cords 69 explode, which in turn causes the various shaped charges 67 to fire substantially simultaneously. The jet that is formed by each of the charges 67 pierces the thin wall section 95 in front of it, and forms a hole in the wall of the casing 11. However, the charges 67 are designed with respect to the volume of explosive, and the shape of the cone liner, such that no damage is done to the wall of the outer casing string 24. A selected number of shots per foot can be made depending upon the number and vertical spacing of the charges 67 in each of the carrier tubes 64. For example, four to sixteen shots per foot can be used. A ten feet long gun can shoot 160 shots at 90° over this interval. Since the connector plugs 84 at the upper end of the adapters 77 close the bottom ends of the carrier tube assemblies, all debris due to firing of the charges is contained within the tubes, and cannot fall into the well.

After the perforating job is completed, the gun 10 is removed from the casing 11 so that cement can be displaced into the inner casing 11 and out through the perforations into the annulus 25. The pattern of the formation of the holes is such that evenly spaced, separate streams of cement enter the annulus 25 and form a solid cement block having no channels in it through which well fluids can migrate.

The gun apparatus 10 can be used in various sizes of casing, due to the mounting of the carrier tubes 64 on the upper and lower pivot arms 20 and 21, and the compliance of the bow springs 17. In a larger size casing, the nut 34 can be advanced downward to enlarge the transverse diameter of the bow springs 17. Although a four-arm device is shown, it will be apparent that more arms could be used, if desired. The firing of the shaped charges 67 leaves no debris in the well bore that might otherwise interfere with other operations.

Since certain changes or modifications can be made in the disclosed embodiment without departing from the inventive concepts involved, it is the aim of the appended claims to cover all such changes and modifications falling within the true spirit and scope of the present invention.

What is claimed is:

1. A perforating gun apparatus for use in forming cement flow paths through the wall of a well casing, comprising: a body adapted to be lowered into a well casing on an electric line; a plurality of, tubular carrier means mounted at angularly spaced positions on said body and being individually moveable inward and outward with respect to said body; means for biasing each of said carrier means outward so that each of said carrier means slides against the adjacent well casing wall; and explosive means mounted within each of said carrier means for forming a flow passage through the wall of the well casing when fired in response to an electrical signal on the electric line.

2. The apparatus of claim 1 wherein each of said tubular carrier means comprises an elongated hollow tube, said explosive means being mounted at axially spaced positions in the bore of said tube; and further including upper and lower linkage arm means coupled between the respective upper and lower ends of said tubes and said body for mounting said tubes on said body.

3. The apparatus of claim 2 when each of said carrier tubes has an upper section and a lower section, said explosive means being mounted in said upper section; and detonator means positioned in each of said lower sections.

4. The apparatus of claim 3 further including seal means for preventing leakage of well fluids into said upper and lower sections, and window means for enabling conductor wires that are connected to said detonator means to extend inward toward said body.

5. The apparatus of claim 4 wherein said body is an elongated hollow, tubular member; and further including conductor means having its lower end connected to at least one of said conductor wires and its upper end electrically connected to the electric line.

6. The apparatus of claim 5 wherein said conductor means is a metallic rod having an outer diameter that is smaller than the inner diameter of said hollow tubular member.

7. The apparatus of claim 1 wherein each of said biasing means comprises a spring member that reacts between said body and a respective one of said carrier means.

8. The apparatus of claim 7 wherein said spring member is a bow spring having upper and lower ends, one of said ends being fixed with respect to said body and the other of said ends being slidably mounted with respect to said body; and a coil spring on said body for urging said other end of said bow spring relatively toward said one end thereof.

9. The apparatus of claim 8 further including means on said body for adjusting the pressure by which said coil spring urges said other end relatively toward said one end.

10. The apparatus of claim 2 where the upper ends of said upper linkage arms and the lower ends of said lower linkage arms are mounted to said body by spider means, one of said spider means being slidably mounted for limited longitudinal movement on said body.

11. A perforating gun apparatus for use in forming holes in the walls of a well casing through which cement can be circulated comprising: a mandrel having a longitudinal bore; means for suspending said mandrel on an armored cable having an electrical conductor therein; a plurality of carrier tubes mounted parallel to the axis of said mandrel at angularly spaced positions therearound, each of said tubes having an upper section and a lower section; upper and lower arm means for attaching the upper and lower ends of said tubes to said mandrel to enable lateral inward and outward movement thereof; spring means engaging each of said carrier tubes for biasing each tube laterally outward so that outer surfaces of said tubes slidably engage the adjacent well casing wall; said upper and lower sections of each of said carrier tubes being sealed against the entry of well fluid; a plurality of shaped charges mounted in each of said upper sections, said charges being operatively associated with an explosive cord; and detonator means mounted in each of said lower sections for exploding said cords and firing said shaped charges so that said charges form holes in said carrier tubes and through the adjacent walls of said casing.

12. The apparatus of claim 11 wherein a window sub is attached to the lower end of each of said lower section and has an opening formed through an inner wall thereof, said mandrel having an opening through its wall adjacent said openings in said lower sections; and insulated conductor means extending through said openings for firing said detonator means.

13. The apparatus of claim 12 further including conductor means in the bore of said mandrel for electrically connecting said conductor means to an electrical conductor in the armored cable.

14. The apparatus of claim 13 wherein said conductor means is a metal rod mounted in said bore.

15. The apparatus of claim 13 wherein said insulated conductor means connects each of said detonator means in series; and further including means for grounding each of said detonator means to said mandrel.

16. The apparatus of claim 11 further including upper and lower spider means mounted on said mandrel, said upper arm means being pivotally attached to said upper spider means and said lower arm means being pivotally attached to said lower spider means; and means for fixing one of said spider means to said mandrel to prevent relative movement between said mandrel and said one spider means.

17. The apparatus of claim 11 further including a conductive rod mounted in the bore of said mandrel for conducting a firing signal to said detonator means, said rod having an outer diameter that is smaller than the inner diameter of said bore.

18. The apparatus of claim 11 wherein said spring means comprises elongated resilient members that are bowed outward toward said carrier tubes and are arranged to engage rear surfaces of said carrier tubes and thereby bias said tubes outward.

19. The apparatus of claim 18 further including coil spring means on said mandrel for urging the upper and lower ends of said resilient members relatively toward one another; and means for adjusting the compression of said coil spring.

20. The apparatus of claim 19 further including a cylindrical member attached to the lower end of said mandrel for supplying weight which pulls said apparatus down into said well casing.

* * * * *